United States Patent [19]

Uchiyama et al.

[11] Patent Number: 4,887,116

[45] Date of Patent: Dec. 12, 1989

[54] LIGHT-SENSITIVE MATERIAL FEEDING RACK

[75] Inventors: Kaoru Uchiyama; Tetuya Ishizuka, both of Tokyo; Kiichiro Sakamoto, Kanagawa, all of Japan

[73] Assignee: Fuji Photo Film Co., Ltd., Kanagawa, Japan

[21] Appl. No.: 239,716

[22] Filed: Sep. 2, 1988

[30] Foreign Application Priority Data

Sep. 2, 1987 [JP] Japan ..... 62-219583
Oct. 9, 1987 [JP] Japan ..... 62-255049

[51] Int. Cl.[4] ..... G03D 3/13

[52] U.S. Cl. ..... 354/320; 354/339; 226/199

[58] Field of Search ..... 354/320, 321, 322, 338, 354/339; 226/189, 196, 197, 198, 199; 134/64 P, 122 P

[56] References Cited

U.S. PATENT DOCUMENTS 3,922,702 11/1975 Gaskell ..... 354/321
3,952,610 4/1976 Hope et al. ..... 354/321 X
4,151,942 5/1979 Hope et al. ..... 354/322 X
4,295,728 10/1981 Nishimoto ..... 134/122 P X
4,312,470 1/1982 Hope et al. ..... 226/189

*Primary Examiner*—A. A. Mathews
*Attorney, Agent, or Firm*—Sughrue, Mion, Zinn, Macpeak & Seas

[57] ABSTRACT

A light-sensitive material feeding rack for feeding a light-sensitive material along a feeding path within a processing tank by holding the material between paired feed rollers. The rack has guide plates extending along the feeding path for guiding the material to the light-sensitive material entrance side of the paired feed rollers. These guide plates are each rotatable about the ends thereof that are closer to the light-sensitive material entrance side. When the rack is to be cleaned, the guide plates are rotated so as to open the interior of the rack, thereby facilitating the cleaning of the rack. After the completion of cleaning, the guide plates are rotated in the opposite direction to be returned to their original condition. Even after the returning of the guide plates, the positional relationship between the feed rollers and the end portions of the guide plates that are closer to the entrance side can be very precisely maintained.

18 Claims, 10 Drawing Sheets

FIG. 1

LIGHT-SENSITIVE MATERIAL FEEDING RACK

BACKGROUND OF THE INVENTION

1. Field of the Invention

The present invention relates to a light-sensitive material feeding rack for use in sending a light-sensitive material into and out from a processing tank.

2. Description of the Related Art

A light-sensitive material such as print paper is fed as it is held between a plurality of pairs of feed rollers rotatably supported by a rack disposed within a processing tank. During such feeding, a light-sensitive material pushed out by a pair of mated feed rollers is then guided by guide plates to the portion of contact between a subsequent pair of feed rollers.

The rack has an arrangement in which the guide plates can be disassembled from the rack when it is necessary to perform a maintenance operation such as cleaning. This arrangement facilitates maintenance operations conducted with respect to the interior of the rack.

However, if the guide plates are dismounted from the rack or moved from their original positions, and if they are then mounted again onto the rack to be returned to their original positions after the completion of a maintenance operation, there is a risk that the guide plates may become displaced from their optimal positions for guiding the light-sensitive material. If the guide plates are mounted at positions displaced from the optimal positions, the guide plates may interfere with the light-sensitive material and damage the surface of the material, or the light-sensitive material may be guided along a path deviated from the correct feeding path.

SUMMARY OF THE PRESENT INVENTION

In view of the above-described circumstances, it is an object of the present invention to provide a light-sensitive material feeding rack which is capable of facilitating maintenance operations for the rack and which is capable of positively guiding a light-sensitive material even after the completion of maintenance.

To this end, according to the present invention, there is provided a light-sensitive material feeding rack for feeding a light-sensitive material along a feeding path within a processing tank, comprising a rack body disposed within the processing tank; feed rollers rotatably supported by the rack body and paired for feeding the light-sensitive material held between pairs of the feed rollers; and guide means extending along the feeding path of the light-sensitive material for guiding the light-sensitive material to the light-sensitive material entrance side of the pairs of feed rollers, the guide means being rotatable about the end portion thereof that is closer to the light-sensitive material entrance side.

In the light-sensitive material feeding rack of the present invention, a light-sensitive material is fed by the guide means to the entrance side of the feed rollers.

The guide means can be rotated about the end portion thereof that is closer to the light-sensitive material entrance side of feed rollers when it is necessary to conduct a maintenance operation for the light-sensitive material feeding rack, thereby opening the interior of the rack. This arrangement facilitates an maintenance operation, e.g. cleaning, of portions of the rack located inward of the guide means.

Further, since the guide means is rotatable about the end portions thereof that is closer to the light-sensitive material entrance side of the feed rollers, this provides the following advantage when the guide means has been returned to its original position after the completion of a maintenance operation. Namely, displacement in position of the guide means is such that the end portion of the guide means that is positioned on the downstream side of the guide means with respect to the direction in which the light-sensitive material is fed is less displaced than the upstream-side end portion of the guide. A light-sensitive material which has immediately been fed from a pair of mated feed rollers moves along a relatively constant path. With such a movement of the material, therefore, even if the position of the guide means has been incorrectly determined, the guide means can be kept from coming into contact with the light-sensitive material and can guide the material without encountering any problem. However, when the light-sensitive material is immediately before it enters the subsequent pair of mated feed rollers, it moves with a relatively large extent of vibration. With such a movement of the material, therefore, if the position of the guide means is incorrect, the guide means may come into unnecessary contact with the light-sensitive material and may fail to guide it properly. According to the present invention, by virtue of the arrangement in which the guide means is rotatable about the end portion thereof that is closer to the light-sensitive material entrance side of the feed rollers, the error in position of this portion can be small even if the position of the guide means has not been determined very precisely. Accordingly, when guide means has been returned to its original position after the completion of a maintenance operation, the path along which the light-sensitive material is fed can be maintained as it is correct, thereby preventing the guide means from interfering with the light-sensitive material and also preventing the light-sensitive material from deviating from the feeding path.

In consequence, the maintenance operation for the rack can be facilitated, and the light-sensitive material can be positively guided even after the completion of maintenance operation.

DESCRIPTION OF THE PREFERRED EMBODIMENTS

Figure 1:
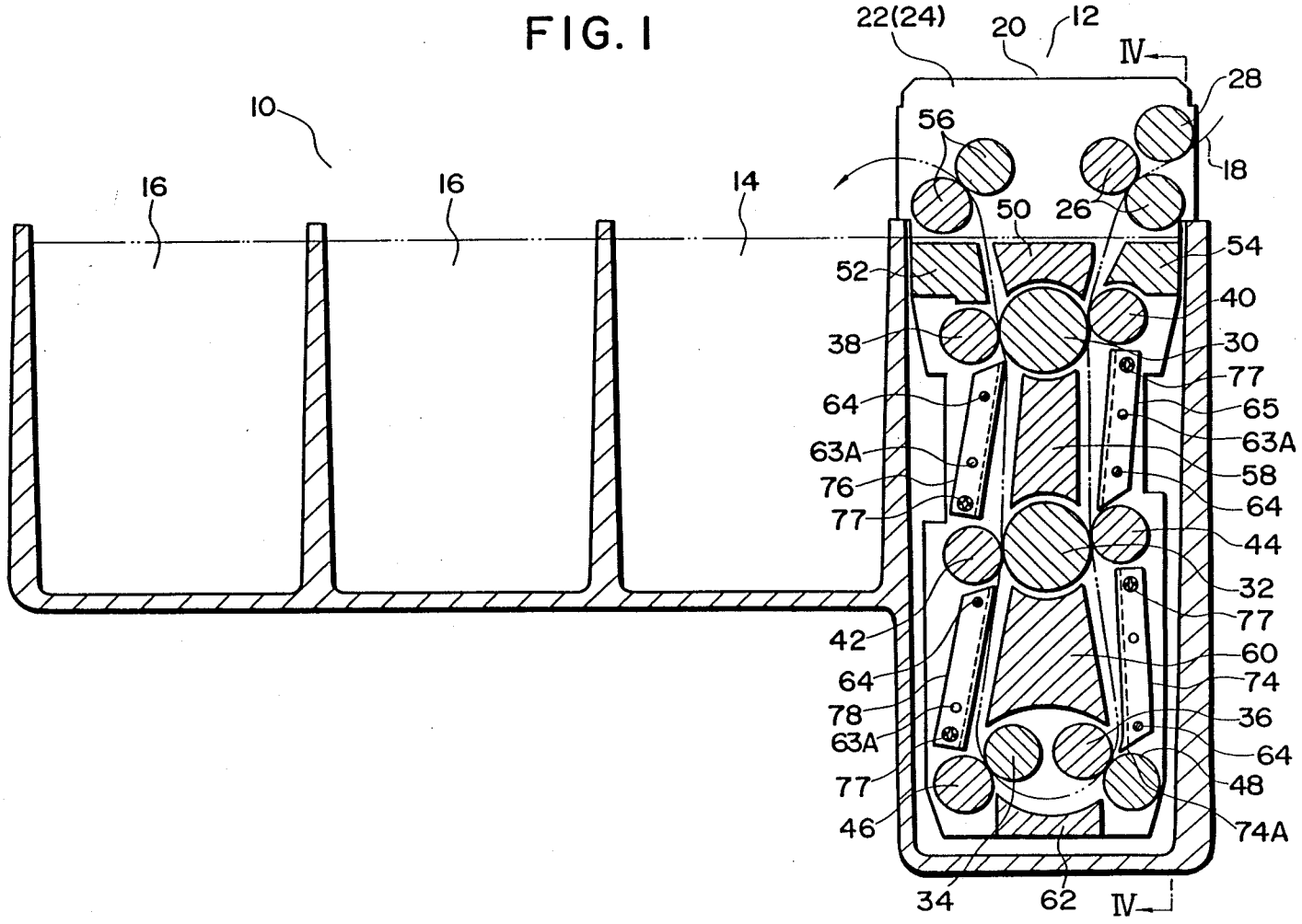
FIG. 1 is a sectional view of a developing apparatus having a light-sensitive material feeding rack in accordance with a first embodiment of the present invention.

FIG. 1 shows a sectional view of a developing apparatus 10 having a light-sensitive material feeding rack in accordance with a first embodiment of the present invention.

The developing apparatus 10 has a developing tank 12, a fixing tank 14, and washing tanks 16 which are successively disposed. The tanks 12 to 16 receive respective processing liquids, and a light-sensitive material 18 is processed by being successively immersed in the liquids within the developing tank 12, the fixing tank 14, and the washing tanks 16 in this order. In the illustrated example, the washing tanks 16 consist of two tanks disposed in sequence.

A light-sensitive material feeding rack 20 is submerged in the processing liquid within the developing tank 12. The light-sensitive material feeding rack 20 is provided with a pair of side plates 22, 24 disposed in parallel to each other (see FIG. 4).

A pair of feed rollers 26 extend between the pair of side plates 22, 24 on one upper side thereof. At a location above the pair of feed rollers 26, a feed roller 28 extends between the side plates 22, 24. Also extending between the side plates 22, 24 are a feed roller 30 located below the pair of feed rollers 26, a feed roller 32 located below the feed roller 30, and two feed rollers 34, 36 located at the same height below the feed roller 32.

On either side of the feed roller 30, feed rollers 38, 40, each having a diameter smaller than that of the feed roller 30, are disposed in contact with the feed roller 30 and extend between the side plates 22 and 24.

Similarly, on either side of the feed roller 32, feed rollers 42, 44, each having a diameter smaller than that of the feed roller 32, are disposed in contact with the feed roller 32 and extend between the side plates 22 and 24, On the outer side of the feed rollers 34 and 36, feed rollers 46, 48, each having the same diameter as that of the feed roller 34 or 36, are disposed in contact with the feed rollers 34, 36, respectively, and extend between the side plates 22 and 24.

The above-stated feed rollers 26 to 48 are adapted to rotate when drive force is transmitted from a drive means via gears (none of which are shown).

A guide block 50 having a generally trapezoid section is disposed above the feed roller 30 and has its two ends fixed to the side plates 22, 24. Further, guide blocks 52, 54 are respectively disposed above the feed rollers 38, 40, and have their ends fixed to the side plates 22 and 24. These guide blocks 52, 54 are disposed at the same height as the guide block 50. The gap between the guide block 50 and the guide block 54 serves as an entrance of the light-sensitive material 18 through which it is fed to the developing tank 12. The light-sensitive material 18 is then guided from the portion of contact between the feed rollers 26 toward the portion of contact between the feed rollers 30, 40.

The gap between the guide blocks 50, 52 serves as an exit of the light-sensitive material 18 through which it is sent out. The material 18 is held between and fed by the feed rollers 30, 38, and it is then guided by the guide blocks 50, 52 so as to be fed to the portion of contact between a pair of feed rollers 56 disposed at an upper location of the side plates 22 and 24.

Intermediate guide blocks 58 and 60 are respectively disposed between the feed rollers 30, 32, and between the feed roller 32 and the feed rollers 34, 36. Two ends of each guide block 58, 60 are fixed to the side plates 22, 24.

A guide block 62 for turning back the light-sensitive material 18 is disposed at a portion of the tank 12 surrounded by the feed rollers 34, 36, 46 and 48, and the bottom surface of the developing tank 12. Two ends of the guide block 62 are fixed to the side plates 22, 24. The upper surface of the light-sensitive material turning guide block 62 is formed with a circular recess whereby the direction in which the light-sensitive material 18 has been fed is changed in such a manner that the material 18 which has been fed from the portion of contact between the feed rollers 36, 48 is guided to the portion of contact between the feed rollers 34, 46.

A light-sensitive material feeding guide 65 is disposed between the feed rollers 40 and 44 at a location corresponding to the intermediate guide block 58. The guide 65 is provided for guiding the light-sensitive material 18 from the portion of contact between the feed rollers 30, 40 to the portion of contact between the feed rollers 32, 44.

Figure 2:
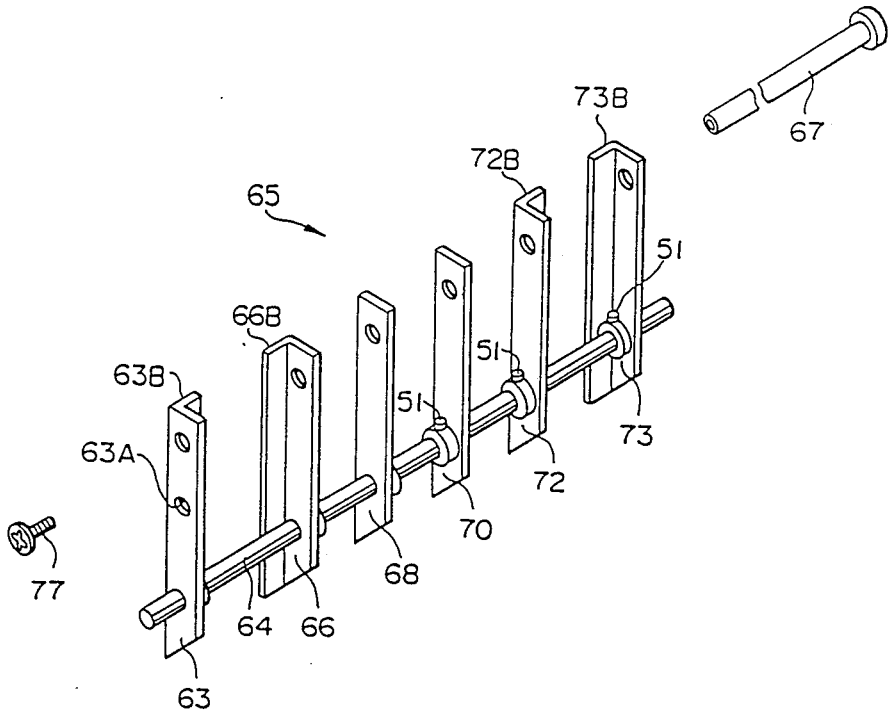
FIGS. 2 and 3 are perspective views of light-sensitive material feeding guides used in the first embodiment.

As shown in FIG. 2, the light-sensitive material feeding guide 65 has a shaft 64 and six guide plates 63, 66, 68, 70, 72, and 73 supported by the intermediate portion of the shaft 64. The shaft 64 passes through these guide plates 63 to 73 in the vicinity of one end portions thereof. The guide plates 63 to 73 are disposed at equal intervals and are fixed to the shaft 64 by means of bolts 51 which are threaded into bosses integrally projecting from the guide plates and which have their tips pressed against the shaft 64. The guide plates 63 to 73 are fixed to the shaft 64 at positions having the same rotational angle about the shaft 64.

Among the six guide plates 63 to 73, those guide plates 63, 73 disposed at longitudinal ends of the shaft 64 are formed with bent pieces 63B, 73B, respectively, which are bent in such a manner as to extend toward each other. The provision of the bent pieces 63B, 73B enables the guide 65 to positively guide the widthwise ends of the light-sensitive material 18. Further, the guide plates 66, 72 are formed with bent pieces 66B, 72B, respectively, which are bent in such a manner as to extend away from each other. The second bent pieces 66B, 72B provide an action similar to that described above. Another shaft 67 passes through the other end portions of the guide plates 63 to 73. A bolt 77 is threaded into a threaded hole formed at one end portion of the shaft 67. Thus, the guide plates 63 to 73 are fixed at identical positions when viewed in the direction of the axis of the shaft 64.

Figure 4:
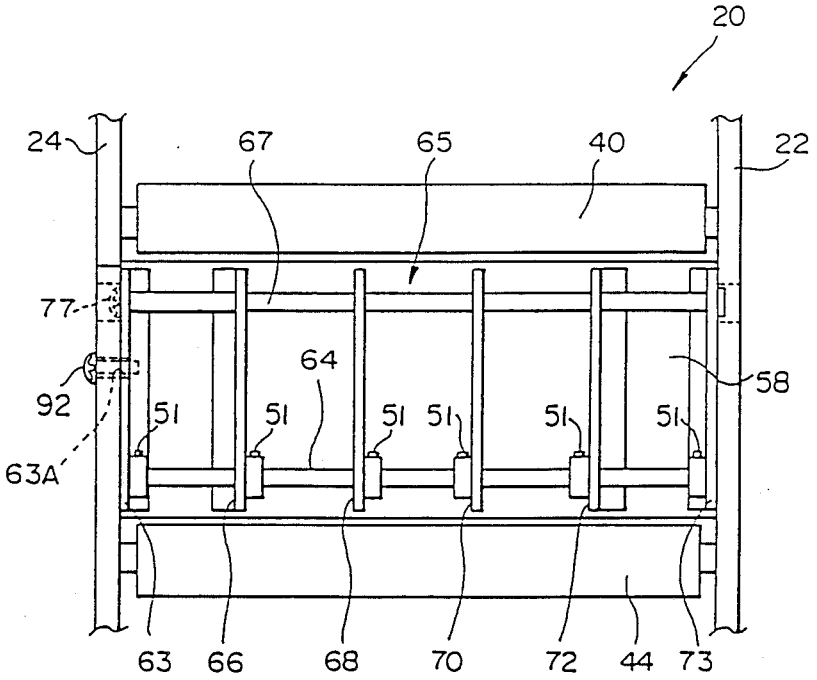
FIG. 4 is a fragmentary sectional view sectioned through the line IV—IV shown in FIG. 1.

The light-sensitive material feeding guide 65, having the above-described members, is mounted onto the light-sensitive material feeding rack 20, by allowing the shaft 64 to extend between the pair of side plates 22, 24 and be supported thereby at its ends. In this condition, the shaft 64 is positioned closer to the feed roller 44 and has its ends supported by the side plates 22, 24, as shown in FIG. 4. That is, the shaft 64 is positioned at the end portion of the guide 65 that is on the downstream side of the guide with respect to the light-sensitive material 18 being fed from the portion of contact between the feed rollers 30, 40 to the portion of contact between the feed rollers 32, 44; in other words, the shaft 64 is positioned in the vicinity of the light-sensitive material 18 entrance side of the feed rollers 32, 44. When the light-sensitive material feeding rack 20 is in use within the developing tank 12, the rack 20 is fixed at a position shown in FIG. 1. At this time, the guide 65 is fixed in place by inserting a bolt 92 penetrating though the side plate 24 into an insertion hole 63A formed in the guide plate 63, as shown in FIG. 4.

The light-sensitive material feeding guide 65 has the end faces of the bent pieces 63B, 66B, 72B, and 73B of the guide plates 63, 66, 72, and 73 as well as the end faces of the guide plates 68 and 70 positioned to correspond to one surface of the light-sensitive material 18, while a face of the guide block 58 corresponds to the other surface of the material 18, so as to guide the light-sensitive material 18 to the portion of contact between the feed rollers 32, 44.

Although the light-sensitive feeding guide 65 may be manufactured by forming the guide plates 63 to 73 and the shaft into an integral structure, if the guide 65 is manufactured in this way, the structure may experience deformation after its forming, thereby causing a reduction in the intervals between the guide plates 63 to 73, and thus leading to a reduction in dimensional precision. To avoid this problem, in the illustrated embodiment, the shaft 64 and the guide plates 63 to 73 are prepared as separate component parts which are then assembled to be integrated. In this way, a sufficient level of precision in dimension is ensured.

Figure 3:
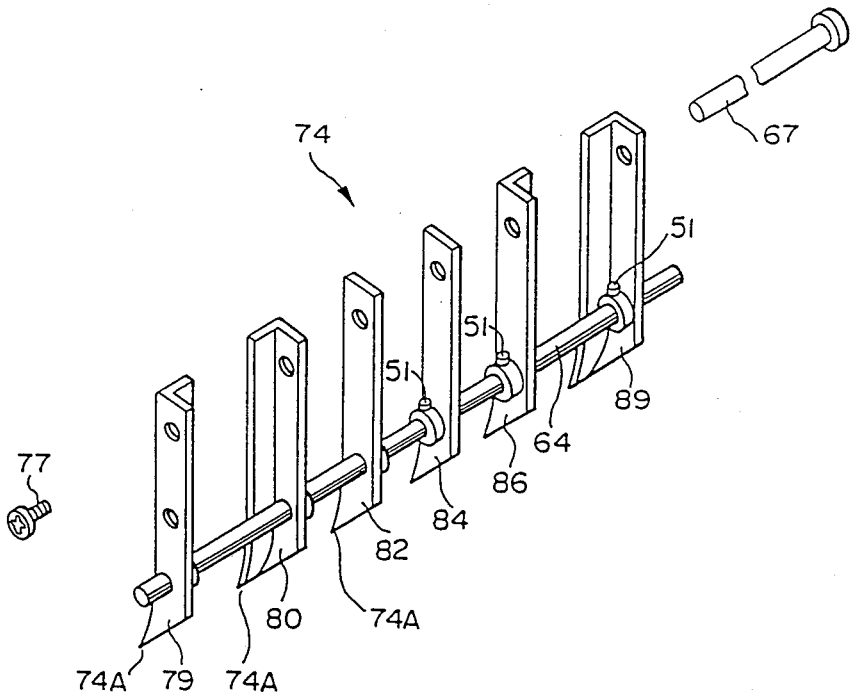

Another light-sensitive material feeding guide 74 is disposed between the feed rollers 44, 48. As shown in FIG. 3, the guide 74 has basically the same structure as that of the guide 65, except that the end portion of the guide 74 positioned in the vicinity of the feed rollers 36, 48 is extended toward the portion of contact between these rollers 36, 48.

That is, as shown in FIG. 3, one end portions of guide plates 79 to 89 of the guide 74 through which a shaft 64 passes are formed as projections 74A that project toward the light-sensitive material 18 when the guide 74 is assembled onto the light-sensitive material feeding rack 20, so as to provide a smooth guiding of the light-sensitive material 18. The shaft 64 of the light-sensitive material feeding guide 74 is disposed in such a manner as to be closer to the feed roller 48. That is, the shaft 64 is disposed at the end portion of the guide 74 that is positioned on the downstream side of the guide with respect to the light-sensitive material 18 being fed; thus, the shaft 64 is disposed at the end portion of the guide 74 that is positioned closer to the feed roller 48. The guide 74 is mounted onto the side plates 22, 24 in a manner similar to that of the guide 65.

A further light-sensitive material feeding guide 76 is disposed between the feed rollers 38, 42. The guide 76 has the same structure as that of the guide 65. A shaft 64 of the guide 76 is disposed in such a manner as to be closer to the feed roller 38. Tat is, the shaft 64 is disposed at the end portion of the guide 76 that is positioned on the downstream side of the guide with respect to the light-sensitive material 18 being fed. The guide 76 is rotatable about that end portion. The guide 76 is fixed to the side plates 22, 24 in a manner similar to that of the guide 65.

The light-sensitive material feeding guide 76 forms a light-sensitive material feeding passage in cooperation with the guide block 58, so as to guide the light-sensitive material 18 to the portion of contact between the feed rollers 38, 30.

A still further light-sensitive material feeding guide 78 is disposed between the feed rollers 42, 46. The guide 78 has the same structure as the guide 65. A shaft 64 of the guide 78 is disposed in such a manner as to be closer to the feed roller 42, this being similar to the case of the guide 76. Similarly to the guide 76, the guide 78 is rotatable about the end portion thereof that is positioned on the downstream side of the guide with respect to the light-sensitive material 18 being fed, in other words, about the end portion of the guide 78 that is positioned closer to the light-sensitive material 18 entrance side of the feed rollers 32, 42. The light-sensitive feeding guide 78 is fixed to the side plates 22, 24 in a manner similar to that of the guide 65.

Next, the operation of the rack in accordance with this embodiment will be described.

The light-sensitive material 18 is fed into the developing tank 12 by being guided by the feed roller 28 and fed by the pair of feed rollers 26. The material 18 thus fed into the developer tank 12 descends within the tank 12 by being held between and fed by the feed rollers 30, 40, the feed rollers 32, 44, and the feed rollers 36, 48. The light-sensitive material 18 which has thus descended within the tank 12 is turned back by the light-sensitive material turning block 62, and it then ascends within the developer tank 12 by being held between and fed by the feed rollers 46, 34, the feed rollers 32, 42, and the feed rollers 38, 30. The light-sensitive material 18 which has thus ascended within the tank 12 is fed out to the fixing tank 14 by being held between the pair of feed rollers 56. By the above-said action, the light-sensitive material 18 is immersed in the liquid within the developing tank 12 to be subjected to development.

While the light-sensitive material 18 is fed by the feed rollers, it descends and then ascends within the developing tank 12 as it is guided. More specifically, it descends within the developing tank 12 as it is guided by the guide blocks 50, 54, the intermediate guide block 58 and the light-sensitive material feeding guide 65, and the intermediate guide block 60 and the light-sensitive material feeding guide 74. Then, the light-sensitive material 18 ascends within the developing tank 12 as it is guided by the intermediate guide block 60 and the light-sensitive material feeding guide 78, the intermediate guide block 58 and the light-sensitive material feeding guide 76, and the guide blocks 50 and 52.

When it is required to perform a maintenance operation of the light-sensitive material feeding rack 20, in particular, a maintenance operation of portions between the intermediate guide block 58 and a member such as the light-sensitive material feeding guide 65 or 76 as well as portions between the intermediate guide block 60 and a member such as the light-sensitive material feeding guide 74 or 78, the light-sensitive material feeding rack 20 is first taken out from the developing tank 12. The bolts 92 are removed, from the insertion holes 63A, and the light-sensitive material feeding guides 65, 74, 76, and 78 are rotated outward about the shafts 64. By this operation, a maintenance operation (e.g., cleaning) of the portions between the guides 65, 76 and the portions between the guides 74, 78 can be performed with ease.

After the completion of the maintenance operation, the light-sensitive material feeding guides 65, 74, 76, and 78 are rotated inward about the shafts 64, to return to their original positions, and are fixed to the side plate 24 by means of the bolts 92.

The light-sensitive material 18 moves describing a relatively constant locus when it has just been fed from the portion of contact between a pair of mated feed rollers. With such movement, therefore, even if the position of the light-sensitive material feeding guides 65, 74, 76, and 78 has been determined incorrectly, they can be kept from contacting the light-sensitive material 18 and can guide the material 18 without encountering any problem. However, the light-sensitive material 18 moves vibrating to a large extent immediately before it enters the next pair of mated feed rollers. With such movement, therefore, if the light-sensitive guides 65, 74, 76, and 78 are incorrectly positioned, there is a risk that the guides 65, 74, 67, and 78 may come into unnecessary contact with the light-sensitive material 18 or may fail to guide it properly.

According to this embodiment of the present invention, the light-sensitive material feeding guides 65, 74, 76, and 78 are rotated, when necessary, about the end portions of the guides that are on the downstream side of the guides with respect to the direction in which the light-sensitive material 18 is fed, thereby causing only a small error in position of those portions. Therefore, when the light-sensitive material feeding guides 65, 74, 76, and 78 have been returned to their original positions after the completion of a maintenance operation, it is possible to maintain correctly the feeding path of the light-sensitive material 18, thereby preventing any interference between the light-sensitive material 18 and the light-sensitive material feeding guides 65, 74, 76, and 78, and thus preventing deviation of the light-sensitive material 18 from the feeding path.

Figure 5:
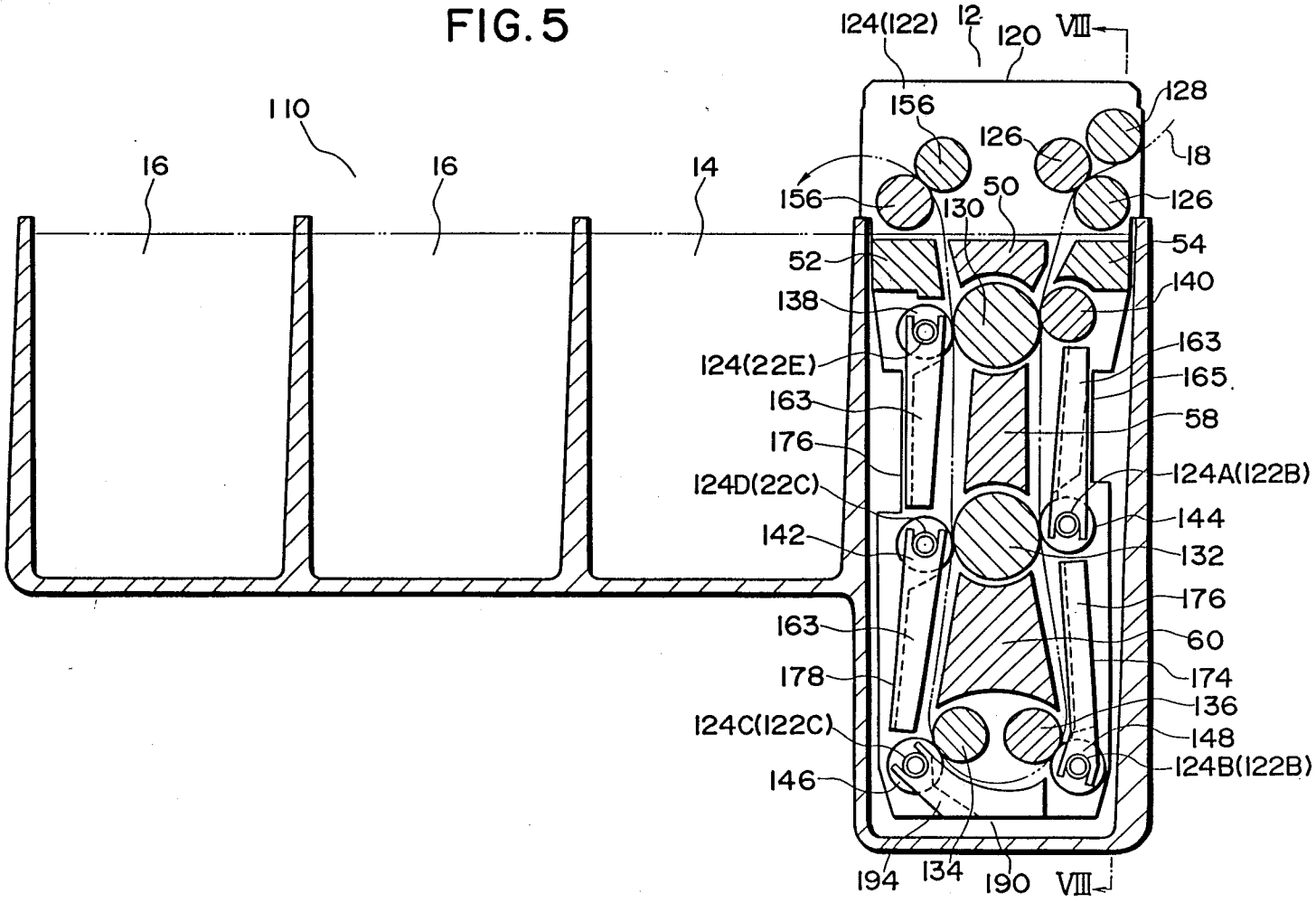
FIG. 5 is a sectional view of a developing apparatus having a light-sensitive material feeding rack in accordance with a second embodiment of the present invention.

FIG. 5 illustrates a sectional view of a developing apparatus 110 having a light-sensitive material feeding rack in accordance with a second embodiment of the present invention. In this embodiment, members, component parts, etc. which are the same or correspond to those of the first embodiment are denoted by the same or corresponding reference numerals, and detailed explanations of those members, etc. will be omitted.

As in the case of the developing apparatus 10 explained in the first embodiment, the developing apparatus 110 has a developing tank 12, a fixing tank 14, and washing tanks 16 which are successively disposed.

A light-sensitive material feeding rack 120 is submerged in a processing liquid received in the developing tank 12. The light-sensitive feeding rack 120 has a pair of side plates 122, 124 disposed in parallel with each other (see FIG. 8).

A pair of feed rollers 126 extend between the pair of side plates 122, 124 at one upper side thereof. At a location above the pair of feed rollers 126, a feed roller 128 extends between the side plates 122, 124. Further, extending between the side plates 122, 124 are a feed roller 130 located below the pair of feed rollers 126, a feed roller 132 located below the feed roller 130, and two feed rollers 134, 136 located at the same height below the feed roller 132.

On either side of the feed roller 130, feed rollers 138, 140, each having a diameter smaller than the feed roller 130, are disposed in contact with the feed roller 130 and extend between the side plates 122, 124.

Similarly, on either side of the feed roller 132, feed rollers 142, 144, each having a diameter smaller than the feed roller 132, are disposed in contact with the feed roller 132 and extend between the side plates 122, 124.

On the outer side of the feed rollers 134, 136, feed rollers 146, 148, each having the same diameter as that of the feed roller 134 or 136, are disposed in contact with the feed rollers 134, 136, respectively, and extend between the side plates 122, 124.

The feed rollers 126 to 148 are adapted to rotate when drive force is transmitted from a drive means via gears (none of which are shown).

Figure 6:
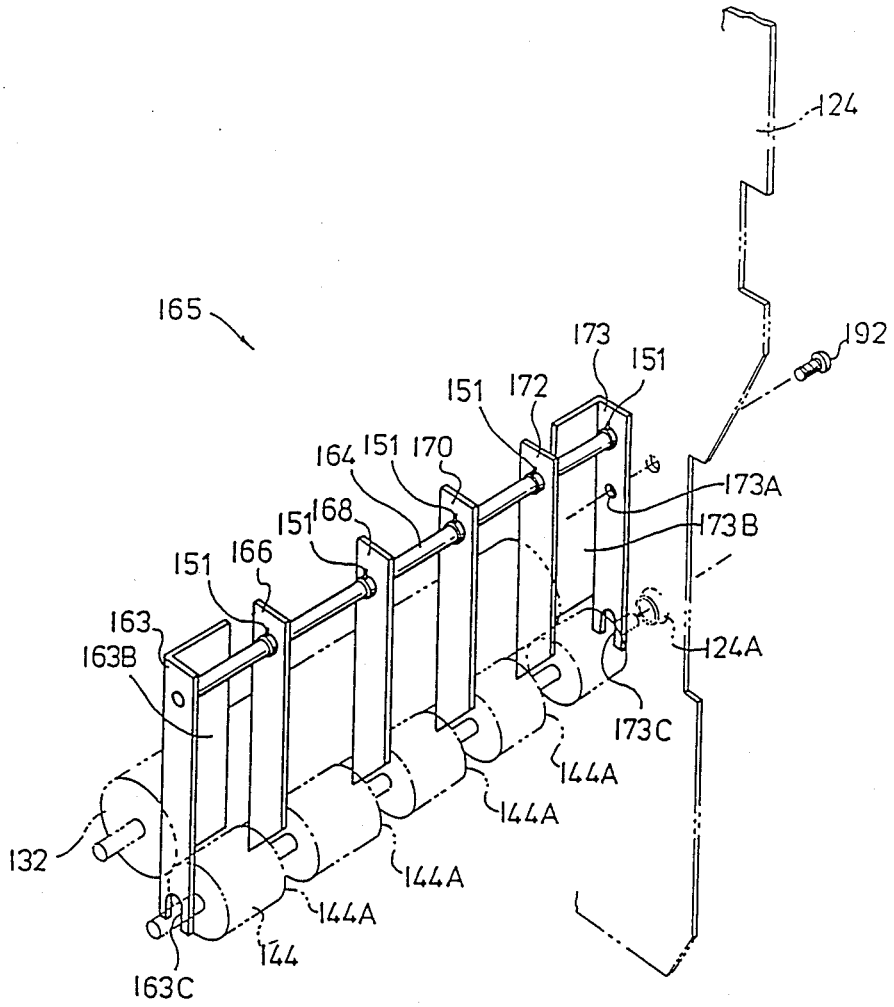
FIG. 6 is a perspective view of a light-sensitive material feeding guide used in the second embodiment.
Figure 7:
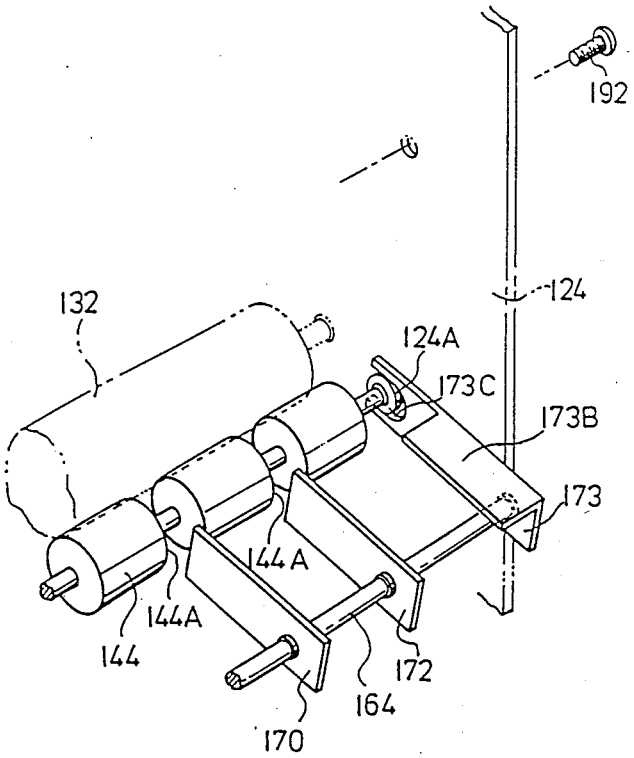
FIG. 7 is a fragmentary perspective view of the light-sensitive material feeding guide shown in FIG. 6, illustrating a state in which the rack is open.
Figure 8:
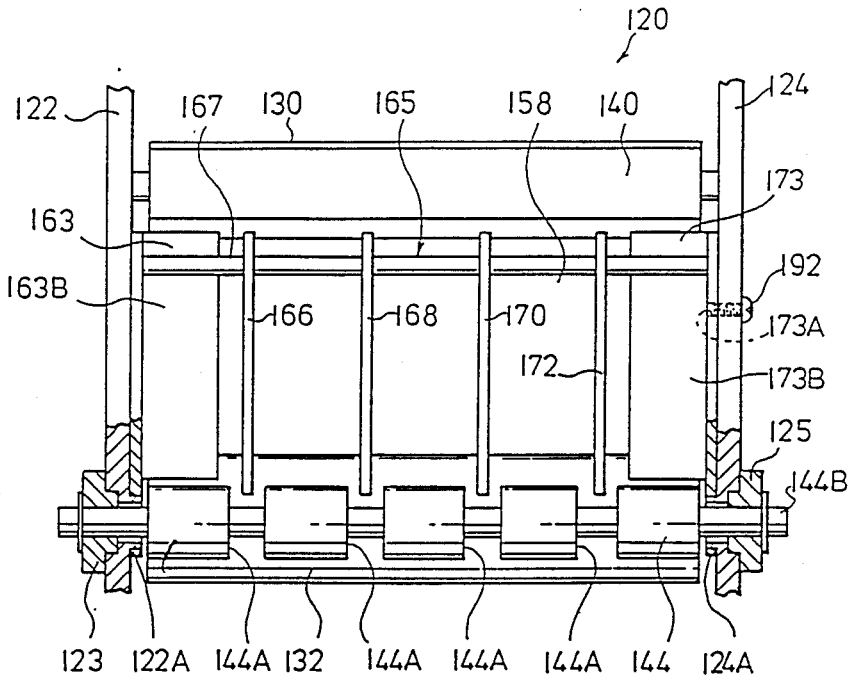
FIG. 8 is a fragmentary sectional view sectioned through the line VIII—VIII shown in FIG. 5.

As shown in FIGS. 6 and 8, the feed roller 144 has four grooves 144A formed in the outer periphery of the axially intermediate portion of the roller 144 by reducing the diameter. The end portions of a rotary shaft 144B of of the feed roller 144 project through the side plates 122, 124 and are supported by bearings 123, 125 provided on the side plates 122, 124. Bosses 122A, 124A are also provided on the side plates 122, 124 in such a manner as to extend towards each other coaxially with the rotary shaft 144B of the feed roller 144.

The feed rollers 138, 124, 126, and 148 each have the same configuration as that of the feed rollers 144 and are each supported by bearings 123, 125 provided on the side plates 122, 124. Bosses 122B, 122C, 122D, 122E, 124B, 124C, 124D and 124E are also provided on the side plates 122, 124 in such a manner as to extend coaxially with rotary shafts of the feed rollers 138, 142, 146, and 148.

Guide blocks 50, 52, 54, and intermediate guide blocks 58, 60 are fixed to the side plates 122, 124. Since these blocks are the same as those of the first embodiment, explanations of those blocks will be omitted.

In this embodiment, a guide block corresponding to the guide block 62 is not provided on the bottom of the rack 120. Instead, a light-sensitive material feeding guide, described later, is provided.

A light-sensitive material feeding guide 165 is disposed between the feed rollers 140, 144 at a location corresponding to the intermediate guide block 58, so as to guide a light-sensitive material 18 fed from the portion of contact between the feed rollers 130, 140 to the portion of contact between the feed rollers 132, 144.

As shown in FIG. 6, the light-sensitive material feeding guide 165 has a shaft 164 and six guide plates 163, 166, 168, 170, 172, and 173 supported by the intermediate portion of the shaft 164. These guide plates 163 to 173 are disposed at equal intervals and are fixed to the shaft 164 by means of bolts 151 which are threaded into bosses integrally projecting from the guide plates 163 to 173 and which have their tips pressed against the shaft 164. The guide plates 163 to 173 are fixed at positions having the same rotational angle about the shaft 164.

Among the six guide plates 163 to 173, those guide plates 163, 173 disposed at the longitudinal ends of the shaft 164 are formed with bent pieces 163B and 173B, respectively, which are bent in such a manner as to extend toward each other. The provision of the bent pieces 163B, 173B enables the guide 165 to positively guide the widthwise end portions of the light-sensitive material 18. Further, the guide plates 163, 173 each have a notch 163C or 173C formed in the end portion thereof that is not the end portion at which the guide plate is fixed to the shaft 164. Each of the notches 163C, 173C is generally rectangular and has a semi-circular bottom surface.

The light-sensitive material feeding guide 165 is fixed to the light-sensitive material feeding rack 120 by inserting the bosses 122A, 124A into the notches 163C, 173C formed in the guide plates 163, 173, and by fixing the guide plate 173 to the side plate 124 by means of a bolt 192. In this condition, the bosses 122A, 124A are coaxial with the feed roller 144 and support the light-sensitive material feeding guide 165, as shown in FIG. 8. That is, in this condition, the bosses 122A, 124A are positioned at the end portion of the guide 165 that is on the downstream side of the guide with respect to the direction in which the light-sensitive material 18 is fed from the portion of contact between the rollers 130, 140 to the portion of contact between the rollers 132, 144. During the use of the light-sensitive material feeding rack 120 within the developing tank 12, the rack 120 is fixed at a position shown in FIG. 5. At this time, the guide 165 is fixed in place by inserting the bolt 192 penetrating through the side plate 124 into an insertion hole 173A formed in the guide plate 173.

The light-sensitive material feeding guide 165 has the end faces of the bent pieces 163B, 173B of the guide plates 163, 173 as well as the end faces of the guide plates 166, 168, 170, and 172 positioned to correspond to one surface of the light-sensitive material 18, while a face of the guide block 58 corresponds to the other surface of the material, so as to guide the light-sensitive material 18 to the portion of contact between the feed rollers 132, 144.

As in the case of the guide of the first embodiment, the light-sensitive material feeding guide 165 of this embodiment is formed by preparing the shaft 164 and the guide plates 163 to 173 as separate component parts, and assembling these parts to integrate them. In this way, a sufficient level of precision for diameters can be ensured.

Figure 9:
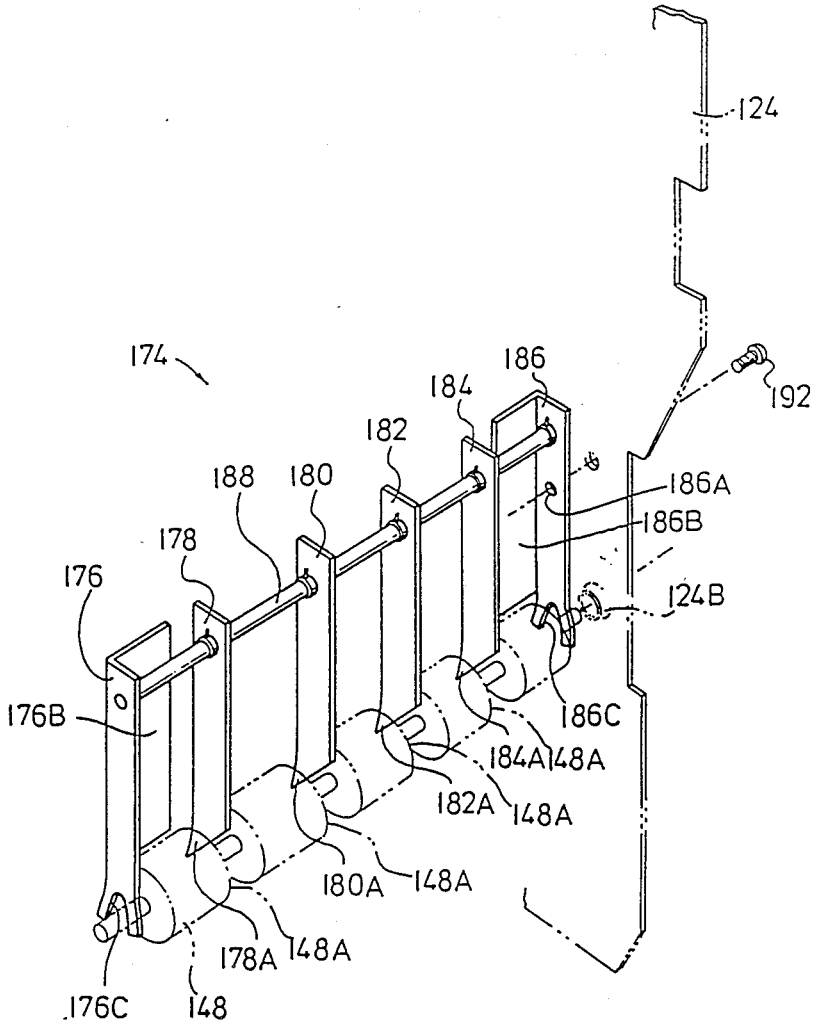
FIGS. 9 and 10 are perspective views of the light-sensitive material feeding guides used in the second embodiment.

Another light-sensitive material feeding guide 174 is disposed between the feed rollers 144, 148. As shown in FIG. 9, the guide 174 has basically the same structure as that of the guide 165, except that the end of the guide 174 positioned in the vicinity of the feed rollers 136, 148 is extended toward the portion of contact between these feed rollers 136, 148.

That is, as shown in FIG. 9, a shaft 188 passes through one end portions of guide plates 176 to 186 of the guide 174, and the other end portions of the guide plates 178 to 184 are formed as projections 178A to 184A which project toward the moving light-sensitive material 18 when the guide 174 is assembled onto the light-sensitive material feeding rack 120, so as to provide a smooth guiding of the light-sensitive material 18. The guide 174 also has notches 176C, 186C formed in such a manner as to be closer to tee feed roller 148. That is, the notches 176C, 186C are disposed at the end portion of the guide 174 that is positioned on the downstream side of the guide with respect to the light-sensitive material 18 being fed. The guide 174 is mounted onto the side plates 122, 124 by means of the bosses 122B, 124B provided on the side plates 122, 124, in a manner similar to that of the guide 165.

A further light-sensitive material feeding guide 176 is disposed between the feed rollers 138, 142. The guide 176 has the same structure as that of the light-sensitive feeding guide 165. Notches 163C, 173C of the guide 176 are formed in such a manner as to be closer to the feed roller 138. That is, the notches 163C, 173C are disposed at the end portion of the guide 176 that is positioned on the downstream side of the guide with respect to the light-sensitive material 18 being fed. The guide 176 is rotatable about the bosses 122E, 124E. The guide 176 is fixed to the side plates 122, 124 in a manner similar to that of the guide 165.

The light-sensitive feeding guide 176 forms a light-sensitive material feeding passage in cooperation with the guide block 158, so as to guide the light-sensitive material 18 to the portion of contact between the feed rollers 138, 130.

A still further light-sensitive material feeding guide 178 is disposed between the feed rollers 142, 146. The guide 178 also has the same structure as the guide 165. Notches 163C, 173C of the guide 178 are formed in such a manner as to be closer to the feed roller 142. The guide 178 is rotatable about the end portion thereof that is positioned on the downstream side of the guide with respect to the light-sensitive material 18 being fed. The guide 178 is fixed to the side plates 122, 124 in a manner similar to that of the guide 165.

In contrast with the first embodiment, according to this embodiment, a light-sensitive material feeding guide 190 is disposed at a portion surrounded by the feed rollers 134, 136, 146 and 148, as well as the bottom surface of the developing tank 12.

Figure 10:
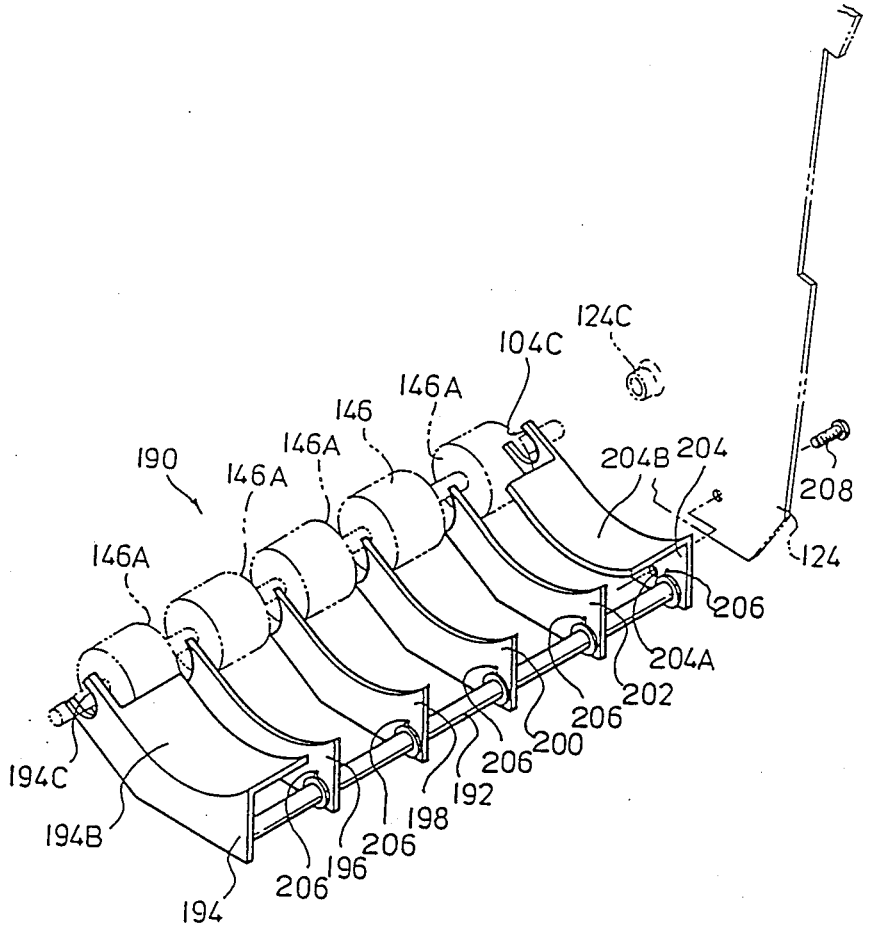

As shown in FIG. 10, the guide 190 has a shaft 192 and six guide plates 194 to 204 supported by the intermediate portion of the shaft 192. These guide plates 194 to 204 are disposed at equal intervals and are fixed to the shaft 192 by means of bolts 206 which are threaded into bosses integrally projecting from the guide plates 194 to 204 and which have their tips pressed against the shaft 192. The guide plates 192 to 204 are fixed at positions having the same rotational angle about the shaft 192.

Each of the guide plates 194 to 204 is formed with a circular configuration, so that the direction in which the light-sensitive material 18 has been fed is changed in such a manner that the material 18 which has been feed from rollers 136 and 148 is guided to the portion of contact between the feed rollers 134, 146.

Among the six guide plates 194 to 204, those guide plates 194, 204 disposed at end portions of the shaft 192 are formed with bent pieces 194B, 204B. These bent pieces 194B and 204B are bent in such a manner as to extend toward each other. The provision of the bent pieces enables the guide 190 to positively guide the widthwise end portions of the light-sensitive material 18.

The end portions of the guide plates 194, 204 that is not the end portions fixed to the shaft 192 are formed with notches 194C, 204C. The light-sensitive material feeding guide 190 is mounted onto the light-sensitive material feeding rack 120 by inserting the bosses 122C, 124C, which are provided on the side plates 122, 124, into the notches 194C, 204C formed in the guide plates 194, 204, and by fixing the guide plate 204 to the side plate 124 by means of a bolt 208.

In this condition, the free end portions of the guide plates 196 to 202 are inserted into grooves 146A formed in the feed roller 146.

Next, the operation of the rack in accordance with this embodiment will be described.

The light-sensitive material 18 is fed into the developing tank 12 by being guided by the feed roller 128 and fed by the pair of feed rollers 126. The material 18 which has thus fed into the developer tank 12 descends within the tank 12 by being held between and fed by the feed rollers 130, 140, the feed rollers 132, 144, and the feed rollers 136, 148. The light-sensitive material 18 which has thus descended within the tank 12 is turned back by the light-sensitive material guide 190, and it then ascends within the developer tank 12 by being held between and fed by the feed rollers 146, 134, the feed rollers 132, 142, and the feed rollers 138, 130. The light-sensitive material 18 which has thus ascended within the tank 12 is fed out to the fixing tank 14 by being held between a pair of feed rollers 56. By the above-said action, the light-sensitive material 18 is immersed in the liquid within the developing tank 12 to be subjected to development.

While the light-sensitive material 18 is fed by the feed rollers, it descends and then ascends within the developing tank 12 as it is guided. More specifically, it descends within the developing tank 12 as it is guided by the guide blocks 50, 54, the intermediate guide block 58 and the light-sensitive material feeding guide 165, and the intermediate guide block 60 and the light-sensitive material feeding guide 174. Then, the light-sensitive material 18 ascends within the developing tank 12 as it is guided by the intermediate guide block 60 and the light-sensitive material feeding guide 178, the intermediate guide block 58 and the light-sensitive material feeding guide 176, and the guide blocks 50 and 52.

When it is required to perform a maintenance operation of the light-sensitive material feeding rack 120, in particular, a maintenance operation of portions between the intermediate guide block 58 and a member such as the light-sensitive material feeding guide 165 or 176, portions between the intermediate guide block 60 and a member such as the light-sensitive material feeding guide 174 or 178, and portions between the feed rollers 134, 136, 146, 148, the light-sensitive material feeding rack 120 is first taken out from the developing tank 12. The bolts 192, 208 are removed from the insertion holes 173A, 186A, 204A, and the light-sensitive material feeding guides 165, 174, 176, 178, and 190 are rotated outward about the bosses 122A to 122E and 124A to 124E. By this operation, the maintenance operation (e.g., cleaning) of the portions, such as those between the guides 165, 176, and between the guides 174, 178, can be performed with ease.

After the completion of the maintenance operation, the light-sensitive material feeding guides 165, 174, 176, 178, and 190 are rotated inward about the bosses 122A to 122E and 124A to 124A, are returned to their original positions, and are fixed to the side plate 124 by means of the bolts 192 and 208.

The light-sensitive material 18 moves describing a relatively constant locus when it has just been fed from the portion of contact between a pair of mated feed rollers. With such movement, therefore, even if the position of the light-sensitive material feeding guides 165, 174, 176, 178, and 190 has been determined incorrectly, they can be kept from contacting the light-sensitive material 18 and can guide the material 18 without encountering any problem. However, the light-sensitive material 18 moves vibrating to a large extent immediately before entering the next pair of mated feed rollers. With such movement, therefore, if the light-sensitive guides 165, 174, 176, 178, and 190 are incorrectly positioned, there is a risk that these guides may come into unnecessary contact with the light-sensitive material 18 or may fail to guide it properly.

According to this embodiment of the present invention, the light-sensitive material feeding guides 165, 174, 176, 178, and 190 are rotated, when necessary, about the end portions of the guides that are on the downstream side thereof with respect to the direction in which the light-sensitive material is fed, thereby causing only a small error in position of those portions. Therefore, when the light-sensitive material feeding guides 165, 174, 176, 178, and 190 are returned to their original positions after the completion of a maintenance operation, it is possible to maintain correctly the feeding path of the light-sensitive material 18, thereby preventing any interference between the light-sensitive material 18 and the light-sensitive material feeding guides 165, 174, 176, 178, and 190, and preventing deviation of the light-sensitive material 18 from the feeding path.

Although in the foregoing embodiments, the light-sensitive material feeding rack is disposed within the development tank 12, the rack in accordance with the present invention may alternatively be used in a processing tank of a different type, such as a fixing or washing tank.

What is claimed is:

1. A light-sensitive material feeding rack for feeding a light-sensitive material along a feeding path within a processing tank, comprising:

a rack body disposed within said processing tank;

feed rollers rotatably supported by said rack body and paired for feeding said light-sensitive material held between pairs of said feed rollers; and guide means extending along said feeding path of said light-sensitive material for guiding said light-sensitive material to a light-sensitive material entrance side of said pairs of feed rollers, said guide means being rotatable about an end portion thereof that is closer to said light-sensitive material entrance said, said guide means comprising a plurality of guide plates disposed at equal intervals in a widthwise direction of said feeding path.

2. A light-sensitive material feeding rack according to claim 1, wherein said guide means further comprises connecting means for connecting said guide plates in such a manner that flat surface portions of adjacent guide plates face one another.

3. A light-sensitive material feeding rack according to claim 1, wherein said guide means is rotatable about a rotary shaft of one of said feed rollers of each pair thereof.

4. A light-sensitive material feeding rack for feeding a light-sensitive material along a feeding path within a processing tank, comprising:

a rack body disposed within said processing tank;

feed rollers rotatably supported by said rack body and paired for feeding said light-sensitive material held between pairs of said feed rollers; and guide means extending along said feeding path of said light-sensitive material for guiding said light-sensitive material to a light-sensitive material entrance side of said pairs of feed rollers, said guide means being rotatable about an end portion thereof that is closer to said light-sensitive material entrance side, wherein said guide means comprises a plurality of guide plates disposed at equal intervals in a widthwise direction of said feeding path, and connecting means for connecting said guide plates in such a manner that flat surface projections of adjacent guide plates face one another, and wherein those of said guide plates disposed outermost in said widthwise direction of said feed path each have a bent portion formed at an end portion thereof that faces said feeding path, said bent portions being bent substantially normally in such a manner as to extend toward each other.

5. A light-sensitive material feeding rack according to claim 4, wherein said guide plates are pivotally supported by said rack body and are secured to a shaft passing through said guide plates, said guide means being rotatable about said shaft.

6. A light-sensitive material feeding rack for feeding a light-sensitive material along a feeding path within a processing tank, comprising:

a rack body disposed within said processing tank;

feed rollers rotatable supported by said rack body and paired for feeding said light-sensitive material held between pairs of said rollers; and guide means extending along said feeding path of said light-sensitive material for guiding said light-sensitive material to a light-sensitive material entrance side of said pairs of feed rollers, said guide means being rotatably about an end portion thereof that is closer to said light-sensitive material entrance side, wherein said guide means is rotatable about a rotary shaft of one of said feed rollers of each pair thereof, and wherein said guide means comprises a plurality of guide plates disposed at equal intervals in a widthwise direction of said feeding path.

7. A light-sensitive material feeding rack according to claim 6, wherein said guide means further comprises connecting means for connecting said guide plates in such a manner that flat surface portions of adjacent guide plates face one another.

8. A light-sensitive material feeding rack according to claim 7, wherein two of said guide plates that are disposed outermost in the widthwise direction of said feeding path each have a bent portion formed at the end portion thereof that faces said feeding path, said bent portions being bent substantially normally in such a manner as to extend toward each other.

9. A light-sensitive material feeding rack according to claim 8, wherein said one of said each pair of feed rollers has annular grooves formed in the outer periphery thereof in correspondence with those of said guide plates interposed between said two guide plates, the tips of the interposed guide plates being inserted into said annular grooves.

10. A light-sensitive material feeding rack according to claim 8, wherein each of said two guide plates disposed outermost in the widthwise direction of said feeding path has a notch formed in the end portion thereof that is closer to said light-sensitive material entrance side, said rotary shaft of said one of said each pair of feed rollers being received in said notches so as to allow the rotation of said guide means.

11. A light-sensitive material feeding rack submerged in a processing liquid within a processing tank for feeding a light-sensitive material along a feeding path, comprising:

a rack body having a pair of side plates facing each other;

feed rollers extending between said guide plates and paired for feeding said light-sensitive material held between pairs of said feed rollers; and guide means disposed along said feed path for guiding said light-sensitive material to portions of contact between said pairs of feed rollers, said guide means being supported by said plates in such a manner as to be rotatable about an end portion thereof that is closer to said feed rollers to which said light-sensitive material is guided, wherein said guide means comprises a plurality of guide plates disposed at equal intervals in a widthwise direction of said feeding path in such a manner that flat surface portions of two adjacent guide plates face one another.

12. A light-sensitive material feeding rack according to claim 11, wherein said guide means further comprises a shaft passing through said flat surface portions of said guide plates, said guide means being rotatably supported by said side plates through said shaft.

13. A light-sensitive material feeding rack submerged in a processing liquid within a processing tank for feeding a light-sensitive material along a feed path, comprising:

a rack body having a pair of side plates facing each other;

feed rollers extending between said side plates and paired for feeding said light-sensitive material held between pairs of said feed rollers; and guide means disposed along said feeding path for guiding said light-sensitive material to portions of contact between said pairs of feed rollers, said guide means being supported by said side plates in such a manner as to be rotatable about an end portion thereof that is closer to said feed rollers to which said light-sensitive material is guided, wherein said guide means comprises a plurality of guide plates disposed at equal intervals in a widthwise direction of said feeding path in such a manner that flat surface portions of two adjacent guide plates face one another, and a shaft passing through said flat surface portions of said guide plates, said guide means being rotatable supported by said side plates through said shaft, and wherein those of said guide plates disposed outermost in said widthwise direction of said feed path each have a bent portion formed at an end portion thereof that faces said feeding path, said bent portions being bent substantially normally in such a manner as to extend toward each other.

14. A light-sensitive material feeding rack submerged in a processing liquid within a processing tank for feeding a light-sensitive material along a feeding path, comprising:

a rack body having a pair of side plates facing each other;

feed rollers extending between said side plates and paired for feeding said light-sensitive material held between pairs of said feed rollers; and guide means disposed along said feeding path so that said guide means extends substantially parallel to said feeding path for guiding said light-sensitive material to portions of contact between said pairs of feed rollers, said guide means being rotatable about a rotary shaft of one of said feed rollers of each pair thereof.

15. A light-sensitive material feeding rack submerged in a processing liquid within a processing tank for feeding a light-sensitive material along a feeding path, comprising:

a rack body having a pair of side plates facing each other;

feed rollers extending between said side plates and paired for feeding said light-sensitive material held between pairs of said feed rollers; and guide means disposed along said feeding path for guiding said light-sensitive material to portions of contact between said pairs of feed rollers, said guide means being rotatable about a rotary shaft of one of said feed rollers of each pair thereof, wherein said guide means comprises a plurality a guide plates disposed at equal intervals in a widthwise direction of said feeding path in such a manner that flat surface portions of two adjacent guide plates face one another.

16. A light-sensitive material feeding rack according to claim 15, wherein said guide means further comprises connecting means for connecting said guide plates in such a manner that flat surface portions of adjacent guide plates face one another.

17. A light-sensitive material feeding rack according to claim 16, wherein two of said guide plates that are disposed outermost in the widthwise direction of said feeding path each have a bent portion formed at the end portion thereof that faces said feeding path, said bent portions being bent substantially normally in such a manner as to extend toward each other.

18. A light-sensitive material feeding rack according to claim 17, wherein said one of said each pair of feed rollers has annular grooves formed in the outer periphery thereof in correspondence with those of said guide plates interposed between said two guide plates, the tips of the interposed guide plates being inserted into said annular grooves.

* * * * *